US005918467A

United States Patent [19]

Kwan

[11] Patent Number: 5,918,467

[45] Date of Patent: Jul. 6, 1999

[54] HEAT SHIELD FOR A GAS TURBINE COMBUSTION CHAMBER

[75] Inventor: William Kwan, Berlin, Germany

[73] Assignee: BMW Rolls-Royce GmbH, Germany

[21] Appl. No.: 08/875,423

[22] PCT Filed: Jan. 25, 1996

[86] PCT No.: PCT/EP96/00300

§ 371 Date: Jul. 28, 1997

§ 102(e) Date: Jul. 28, 1997

[87] PCT Pub. No.: WO96/23175

PCT Pub. Date: Aug. 1, 1996

[30] Foreign Application Priority Data

Jan. 26, 1995 [DE] Germany ..... 195 02 328. 5

[51] Int. Cl.[6] ..... F02C 3/06; F23R 30/10

[52] U.S. Cl. ..... 60/754; 60/752

[58] Field of Search ..... 60/748, 752, 755, 60/756, 757, 758, 760, 759, 754

[56] References Cited

U.S. PATENT DOCUMENTS 5,129,231 7/1992 Becker et al. ..... 60/754
5,271,219 12/1993 Richardson ..... 60/756
5,307,637 5/1994 Stickles et al. ..... 60/756
5,323,602 6/1994 Defever ..... 60/752

FOREIGN PATENT DOCUMENTS 2312654 12/1976 France .
1572336 7/1980 United Kingdom .

*Primary Examiner*—Timothy S. Thorpe
*Assistant Examiner*—Ted Kim
*Attorney, Agent, or Firm*—Evenson, McKeown, Edwards & Lenahan, P.L.L.C.

[57] ABSTRACT

A heat shield for a gas turbine annular combustion chamber having a plurality of effusion holes (5), the central axes of which are inclined towards the heat shield surface and over which cooling air can penetrate from the rear to apply a film of cooling air to the hot surface. The surface is subdivided into sectors (7) and transition areas (10) between the sectors, the central axes of the effusion holes essentially being arranged in parallel to each other in a given sector or transition area. In addition, the central axes (6) of the effusion holes (5) located in each surfaces sector (7) are parallel to one another and extend substantially toward the associated corner area (8) and, in sections, extending approximately in a direction the same as the fuel combustion air swirl (4) in this sector (7).

13 Claims, 2 Drawing Sheets

HEAT SHIELD FOR A GAS TURBINE COMBUSTION CHAMBER

BACKGROUND AND SUMMARY OF THE INVENTION

The present invention relates to a heat shield for a combustion chamber, particularly for an annular combustion chamber of a gas turbine, having a passage opening for a fuel injector, by way of which fuel as well as combustion air arrives in the combustion chamber while forming a swirl, as well as having a plurality of effusion holes where their central axes are inclined toward the heat shield surface and by way of which the cooling air can penetrate from the rear in order to apply a film of cooling air to the hot surface.

A heat shield provided in the head of a combustion chamber is conventionally used for protecting the dome-shaped combustion chamber head area or the front plate provided therein as well as the fuel injector itself from the effect of the hot gas situated in the combustion chamber and from an excessive heat radiation. In order to be able to carry out this function, the heat shield itself must be cooled. For this purpose, the conventional heat shields have so-called effusion holes so that cooling air can penetrate from the rear in order to apply a cooling air film to the hot surface of the heat shield.

However, because it is not always possible to sufficiently cool all vulnerable zones of the heat shield according to the state of the art, an object of the invention is to provide measures for achieving an improved heat shield cooling.

For achieving this object, a surface sector is assigned to each corner area of the heat shield which extends into this corner area. The central axes of the effusion holes in these surfaces sectors are oriented in parallel to one another and essentially toward the assigned corner area and, in sections, extend approximately in the same direction as the fuel combustion air swirl in this sector. The surface sectors are separated from one another by one transition zone respectively having effusion holes whose central axes extend essentially in parallel to one another. The surface sectors, together with the transition zones, form the total surface of the heat shield.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

The heat shield 1 is arranged conventionally in the head of a gas turbine annular combustion chamber and has the hot surface 1*a* shown in top view. Conventionally, this heat shield has a central passage opening 2 for a burner which is bounded by a surrounding collar 3. The swirl 4 is generated by the fuel injector and under which fuel as well as combustion air is discharged from the fuel injector into the combustion chamber in a generally known manner.

Figure 1:
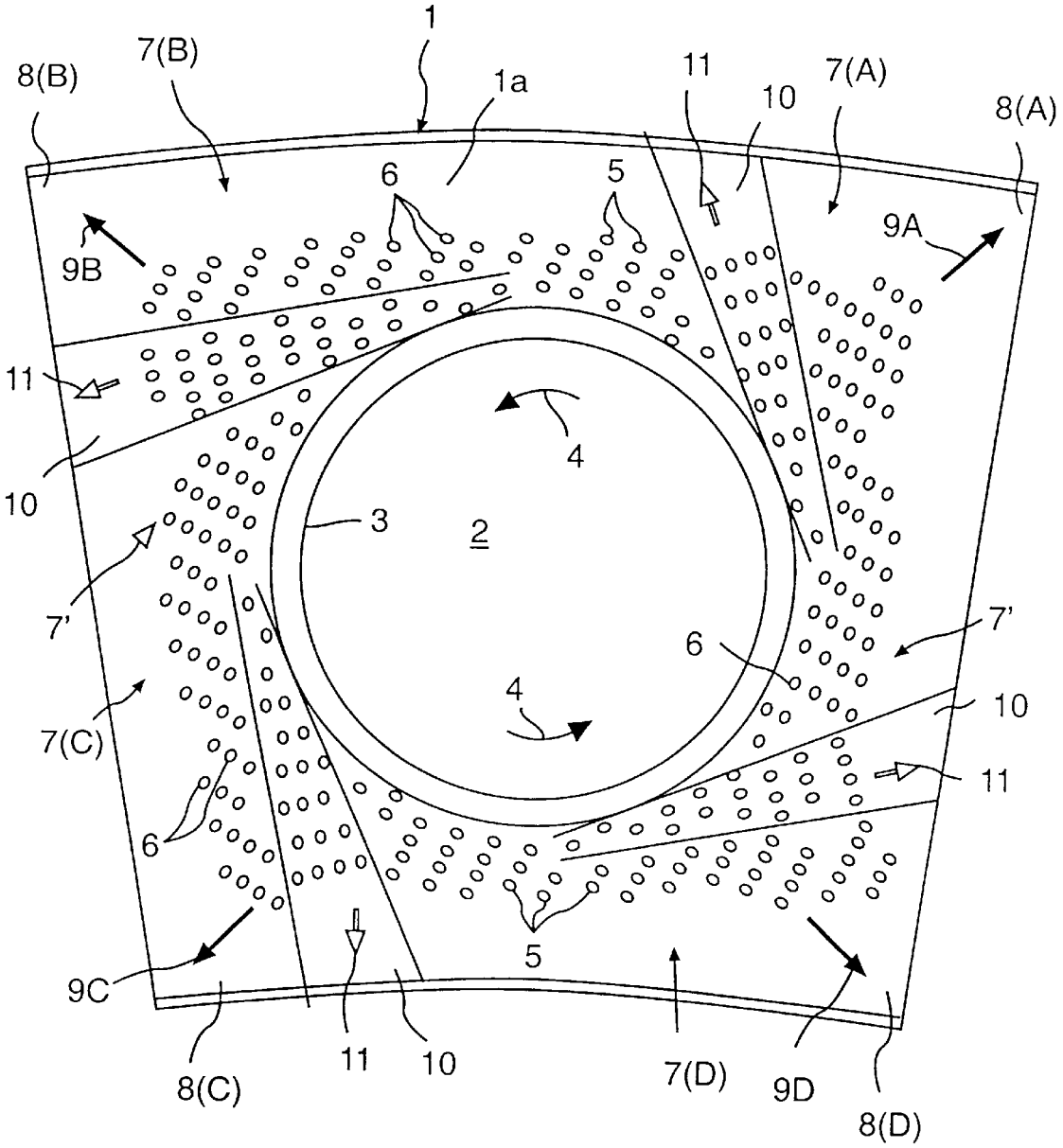
FIG. 1 is a top view of the hot surface of a heat shield according to the present invention.
Figure 2:
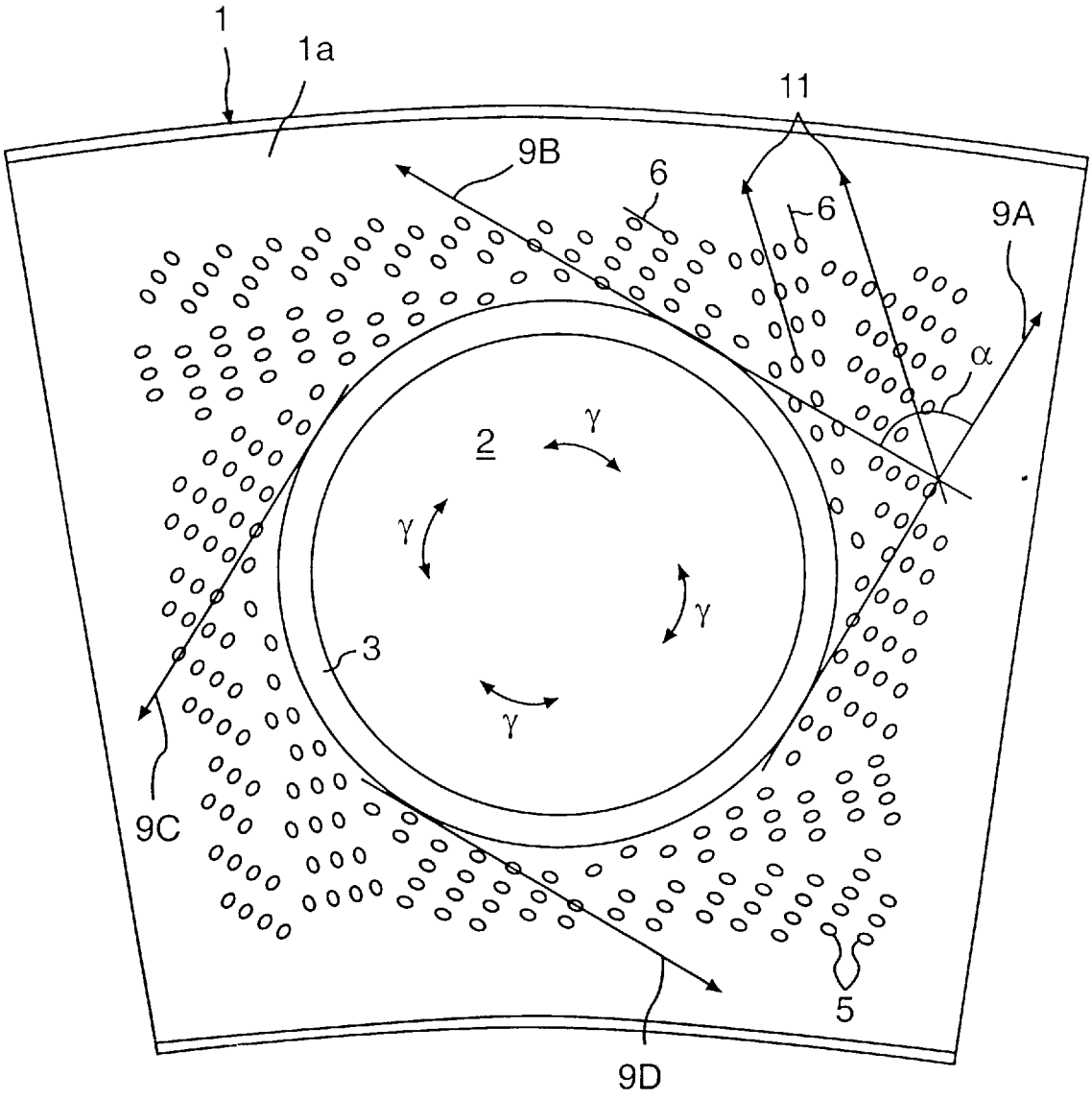
FIG. 2 is a similar view which explains the orientation of the central axes of the effusion holes.

Furthermore, the heat shield 1 has a plurality of effusion holes 5 by way of which cooling air can arrive from the cold rear of the heat shield, and through the heat shield, in the gas turbine combustion chamber situated on the viewer's side of FIGS. 1 and 2. These effusion holes 5 are drilled diagonally; that is, the central axes 6 of the effusion holes 5 are not disposed perpendicularly on the surface 1*a* of the heat shield

1 but are inclined with respect to the surface 1*a*. This measure, which is known per se, has the effect that at least a portion of the cooling air flow penetrating the heat shield 1 by way of the effusion holes 5 is applied as a cooling air film to the hot surface 1*a* of the heat shield 1 which results in an intensive cooling. The central axes 6 of the individual effusion holes 5 are inclined in different manners, as illustrated in the perpendicular projections of the central axes 6 onto the surface 1*a* illustrated in FIGS. 1 and 2, which, in particular, is also the result of the elliptical shape of the otherwise circular effusion holes 5. The larger main axis of each ellipse coincides with the projection of the central axis 6. As illustrated, in different areas of the surface 1*a,* the ellipses of the effusion holes have different orientations.

Specifically, the surface 1*a* of the heat shield 1 is divided into four surface sectors 7 which are each closest to a corner area 8 of the heat shield 1 and in which the central axes 6 of the effusion holes 5 are essentially oriented toward the corner or corner area. For a better explanation, the individual corner areas 8 as well as the respective assigned sectors 7 are marked by the same letters A, B, C, D in parentheses.

In each sector 7, the central axes 6 of the effusion holes are therefore essentially aligned parallel to one another and are oriented toward the respective corner area 8. As a result, the thermally highly stressed corner areas which are not sufficiently cooled in the known state of the art, particularly in U.S. Pat. No. 5,129,231, are cooled in an extremely effective manner here. Because of the essentially parallel orientation of the center axes 6 of all effusion holes 5, an intensive so-called flow pattern, illustrated by the arrows 9A, 9B, 9C, 9D, is formed in each sector 7 in the cooling air film. Consequently, a sufficiently intensive cooling air flow will reach the respective corner areas 8(A)–8(D).

In order not to hinder the formation of the respective flow patterns 9A, 9B, 9C, 9D by the swirl 4 caused by the burner in the passage opening 2, care should be taken with respect to the construction of the effusion holes 5 or the position of the center axes 6 that the central axes 6 in each sector, in sections, have approximately the same direction as the fuel combustion air swirl 4 in this respective sector 7. In particular, the central axes 6 have the same orientation as the swirl in the sector 7 in that section of the sector 7 in which the central axes 6 of the effusion holes are essentially aligned tangentially with respect to the passage opening 2 of the burner. As illustrated, this is a sector edge area 7' which faces away from the assigned corner area 8.

However, the four sectors 7 do not cover the entire surface 1*a* of the heat shield 1. On the contrary, a transition zone 10 is in each case situated between two sectors 7, in which transition zone 10 effusion holes 5 are also provided with central axes 6 which are inclined with respect to the surface 1*a* and are oriented essentially parallel to one another. Because of the parallel orientation of the central axes 6 of the effusion holes, a separate flow pattern forms again in the cooling air film in each of the transition zones, which flow pattern is illustrated by arrows 11. As illustrated, as a result of these cooling air film flow patterns 11, particularly the heat shield edges which are situated between the corner areas 8 of the heat shield and are not indicated in detail are cooled extremely intensively.

The orientation of the flow patterns 11 and of the central axes 6 of the effusion holes in the transition zones is illustrated in particular in FIG. 2. As illustrated, the heat shield 1 has four corners or corner areas 8(A)–8(D). As a result, four sectors 7 are also situated on the surface 1*a,* in which case the central axes 6 of the effusion holes form a right angle with one another in the sectors assigned to the mutually adjacent corner areas 8. In FIG. 2, this is illustrated by the flow patterns 9A to 9D. Thus, the flow pattern 9A forms a right angle $\alpha$ with the flow pattern 9B; similarly, a right angle is situated between the flow patterns 9B and 9C as well as 9C and 9D and between 9D and 9A. The individual sector edge areas 7' are also repeated—as illustrated by the angle γ—in steps of 90°.

As to the orientation of the flow patterns 11, the central axes 6 of the effusion holes in the transition zones 10 are oriented in the direction of the bisecting lines of the angle α formed by the central axes 6 of the effusion holes of the two adjacent sectors 7. The flow pattern 11 for the transition zone 10 situated on top in FIG. 2 therefore forms the bisecting line of the 90°-angle α between the flow patterns 9A and 9B. The same also applies analogously to the flow patterns 11 in the other transition zones 10.

As illustrated, a portion of the flow patterns 9A to 9D is also used for cooling the heat shield edge areas which are situated between the heat shield corner areas 8 and are not marked in detail. As shown, it is possible for this reason to provide a larger number of effusion holes 5 in the sectors 7 than in the transition zones 10. The number of the respective effusion holes 5 in the respective sectors 7 and transition zones 10 can appropriately be adapted to the respective existing geometrical conditions. With the illustrated construction and arrangement of the effusion holes 5, an optimal cooling as the result of the cooling air film on the heat shield surface 1*a* can always be achieved. In this case, the formation of the cooling air film is not hindered by the fuel injector swirl 4, although deviating from the known state of the art according to U.S. Pat. No. 5,129,231, no cooling air film swirl occurs on the heat shield surface 1*a*. This fact becomes particularly obvious when the flow conditions in the boundary areas between the individual sectors 7 as well as the adjacent transition zones 10 are analyzed. The reason is that the mutually deviating velocity components cancel one another there so that finally a cooling air film flow occurs which is oriented essentially radially from the passage opening 2 to the outside, that is, to the heat shield edge area. A heat shield according to the invention is also particularly advantageous in that, particularly close to the surrounding collar 3 of the passage opening 2, the effusion holes 5 can simply be placed mechanically in the heat shield 1 because these effusion holes 5 in this area are oriented essentially tangentially with respect to the collar 3. Despite this tangential alignment, no undesirable cooling air film swirl is generated because, according to the above explanations, a cooling air film flow occurs which is oriented radially from the passage opening 2 to the outside, caused by the essentially parallel alignment of the central axes 6 of the effusion holes in the respective sectors 7 as well as the transition zones 10.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. Heat shield for a gas turbine combustion chamber, comprising a heat shield (1), a fuel injector passage opening (2) in the heat shield (1) for admitting swirled fuel and combustion air into a combustion chamber, and a plurality of effusion holes (5) with central axes (6) inclined toward a heat shield surface (1*a*) of the heat shield (1) such that cooling air can penetrate from a rear surface thereof in order to apply a film of cooling air to the heat shield surface (1*a*), wherein a surface sector (7) is associated with each corner area (8) of the heat shield (1), the central axes (6) of the effusion holes (5) located in each surfaces sector (7) being parallel to one another and extending substantially toward the associated corner area (8) and, in sections, extending approximately in a direction the same as the fuel combustion air swirl (4) in this sector (7), and each surface sector (7) being separated by a respective transition zone (10) having the effusion holes (5) with central axes (6) extend substantially parallel to each other, the surface sectors (7), together with the transition zones (10), forming surface (19) of the heat shield (1).

2. The heat shield according to claim 1, wherein, in a sector edge area (7') facing away from the associated corner area (8), the central axes (6) of the effusion holes are oriented essentially tangentially with respect to the fuel injector passage opening (2).

3. The heat shield according to claim 1, wherein, in the transition zones (10), the central axes (6) of the effusion holes (5) are oriented substantially in a direction of a bisecting line of an angle (α) formed by the central axes (6) of the effusion holes of the two adjacent sectors (7).

4. The heat shield according to claim 3, wherein, in a sector edge area (7') facing away from the associated corner area (8), the central axes (6) of the effusion holes are oriented essentially tangentially with respect to the fuel injector passage opening (2).

5. The heat shield according to claim 1, wherein more effusion holes (5) are provided in the sectors (7) than in the transitions zones (10).

6. The heat shield according to claim 5, wherein, in a sector edge area (7') facing away from the associated corner area (8), the central axes (6) of the effusion holes are oriented essentially tangentially with respect to the fuel injector passage opening (2).

7. The heat shield according to claim 6, wherein, in the transition zones (10), the central axes (6) of the effusion holes (5) are oriented substantially in a direction of a bisecting line of an angle (α) formed by the central axes (6) of the effusion holes of the two adjacent sectors (7).

8. The heat shield according to claim 1, wherein four corner areas (8) are provided such that the central axes (6) of the effusion holes (5) of the sectors (7) assigned to mutually adjacent corner areas form a right angle.

9. The heat shield according to claim 8, wherein, in a sector edge area (7') facing away from the associated corner area (8), the central axes (6) of the effusion holes are oriented essentially tangentially with respect to the fuel injector passage opening (2).

10. The heat shield according to claim 9, wherein, in the transition zones (10), the central axes (6) of the effusion holes (5) are oriented substantially in a direction of a bisecting line of an angle (α) formed by the central axes (6) of the effusion holes of the two adjacent sectors (7).

11. The heat shield according to claim 8, wherein more effusion holes (5) are provided in the sectors (7) than in the transitions zones (10).

12. The heat shield according to claim 11, wherein, in a sector edge area (7') facing away from the associated corner area (8), the central axes (6) of the effusion holes are oriented essentially tangentially with respect to the fuel injector passage opening (2).

13. The heat shield according to claim 12, wherein, in the transition zones (10), the central axes (6) of the effusion holes (5) are oriented substantially in a direction of a bisecting line of an angle (α) formed by the central axes (6) of the effusion holes of the two adjacent sectors (7).

* * * * *